US011628676B2

(12) United States Patent
Miyasaka

(10) Patent No.: US 11,628,676 B2
(45) Date of Patent: Apr. 18, 2023

(54) RECORDING DEVICE AND RECORDING METHOD

(71) Applicant: SEIKO EPSON CORPORATION, Tokyo (JP)

(72) Inventor: Atsushi Miyasaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 129 days.

(21) Appl. No.: 17/304,425

(22) Filed: Jun. 21, 2021

(65) Prior Publication Data

US 2021/0394532 A1 Dec. 23, 2021

(30) Foreign Application Priority Data

Jun. 23, 2020 (JP) ..... JP2020-107929

(51) Int. Cl.
*B41J 11/00* (2006.01)
*B41J 11/42* (2006.01)

(52) U.S. Cl.
CPC ..... *B41J 11/00212* (2021.01); *B41J 11/42* (2013.01)

(58) Field of Classification Search
CPC ..... B41J 11/00212; B41J 11/42
See application file for complete search history.

(56) References Cited

U.S. PATENT DOCUMENTS

2014/0285563 A1 9/2014 Oshima

FOREIGN PATENT DOCUMENTS

JP 2012215835 A * 11/2012 ..... B41J 2/385
JP 2014-184665 A 10/2014

* cited by examiner

*Primary Examiner* — Justin Seo
(74) *Attorney, Agent, or Firm* — Workman Nydegger

(57) ABSTRACT

A recording device including a feeding unit configured to feed out a target recording medium while supporting the target recording medium in a roll form, a head that ejects ink to a surface of the target recording medium fed from the feeding unit thereby forming an image on the surface, a corona irradiation unit that is arranged between the feeding unit and the head in a transport path of the target recording medium and modifies the surface by performing corona irradiation, and a transport path length changing unit that is arranged between the corona irradiation unit and the head and changes a length of the transport path.

8 Claims, 11 Drawing Sheets

RECORDING DEVICE AND RECORDING METHOD

The present application is based on, and claims priority from JP Application Serial Number 2020-107929, filed Jun. 23, 2020, the disclosure of which is hereby incorporated by reference herein in its entirety.

BACKGROUND

1. Technical Field

The present disclosure relates to a recording device and a recording method.

2. Related Art

Recording devices of various configurations have been used. Of these, in order to improve recording quality, a recording device that performs corona irradiation to a surface of a target recording medium to modify the surface and forms an image on the target recording medium with the modified surface is disclosed. For example, JP-A-2014-184665 discloses a printer that includes a corona discharge device and ejects ink from a recording head onto a surface of a recording medium on which the corona discharge is performed.

As in the printer described in JP-A-2014-184665, by performing the corona irradiation and modifying the surface of the target recording medium before ejecting ink from the head to form an image thereon, recording quality can be improved. However, as a result of diligent research by the present inventors, the following has been found. When the corona irradiation is performed, radicals generated by the corona irradiation may attach to the surface of the target recording medium. Then, when a portion to which the radical is attached is transported to a region facing the head, the radical may be attracted to a nozzle forming surface of the head by static electricity, and ink component such as ink mist may be also attracted to the nozzle forming surface by static electricity. As a result, the radical and the ink component may be polymerized on the nozzle forming surface to generate a polymerized foreign material, and deposits of the foreign material may be formed on the nozzle forming surface. In particular, when PET (polyethylene terephthalate) or the like is used as the target recording medium, such a phenomenon is likely to occur. Further, when the deposit of the foreign material is formed on the head, it may cause ejection defects such as deviation of the ejecting direction of the ink from a desired direction. Therefore, it is required to suppress that the radical generated by the corona irradiation causes the ejection defect.

SUMMARY

In order to solve the above-described problem, a recording device according to the present disclosure includes a feeding unit configured to feed out a target recording medium while supporting the target recording medium in a roll form, a head configured to eject ink to a surface of the target recording medium fed from the feeding unit, thereby forming an image on the surface, a corona irradiation unit arranged between the feeding unit and the head in a transport path of the target recording medium and configured to modify the surface by performing corona irradiation, and a transport path length changing unit arranged between the corona irradiation unit and the head in the transport path and configured to change a length of the transport path.

Further, in order to solve the above-described problem, a recording method according to the present disclosure is a recording method in a recording device including a feeding unit configured to feed out a target recording medium while supporting the target recording medium in a roll form, a head configured to eject ink to a surface of the target recording medium fed from the feeding unit, thereby forming an image on the surface, a corona irradiation unit arranged between the feeding unit and the head in a transport path of the target recording medium and configured to modify the surface by performing corona irradiation, the recording method including changing a length of the transport path between the corona irradiation unit and the head, and subsequently transporting the target recording medium and forming an image by the head.

DESCRIPTION OF EXEMPLARY EMBODIMENTS

Figure 1:
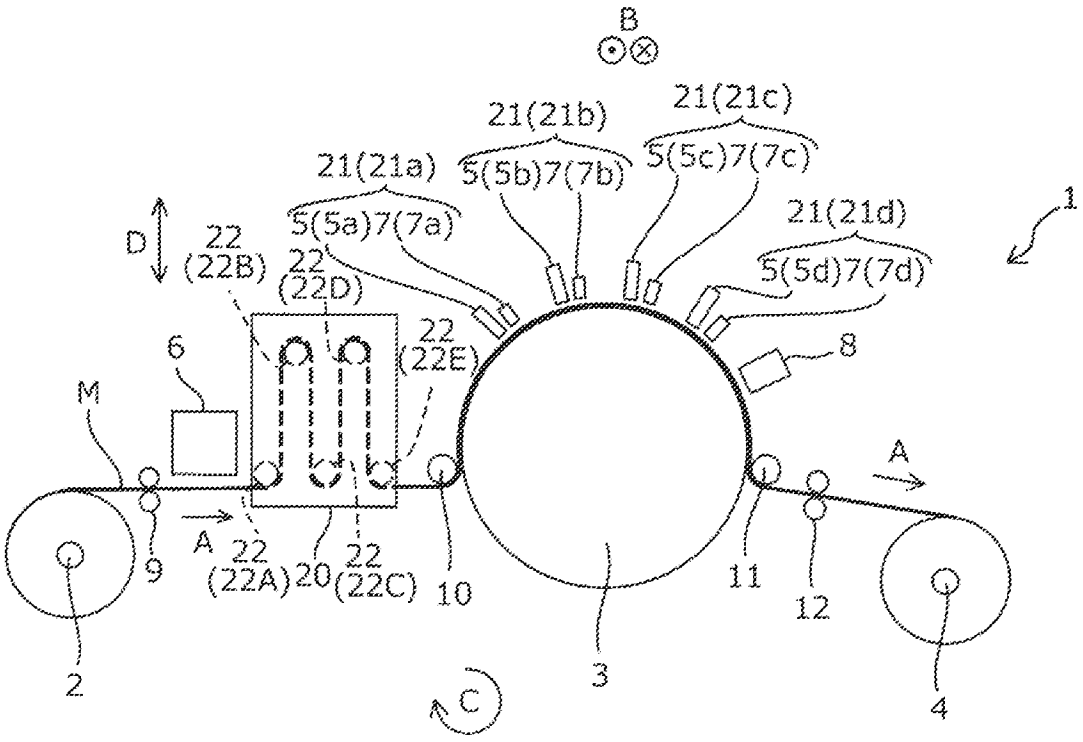
FIG. 1 is a schematic side view of a recording device according to Example 1 of the invention.

First, the present disclosure will be schematically described.

In order to solve the above-described problem, a recording device according to a first aspect of the present disclosure includes a feeding unit configured to feed out a target recording medium while supporting the target recording medium in a roll form, a head configured to eject ink to a surface of the target recording medium fed from the feeding unit, thereby forming an image on the surface, a corona irradiation unit arranged between the feeding unit and the head in a transport path of the target recording medium and configured to modify the surface by performing corona irradiation, and a transport path length changing unit arranged between the corona irradiation unit and the head in the transport path and configured to change a length of the transport path.

Radicals generated by corona irradiation are deactivated after a predetermined time, and according to the present aspect, the transport path length changing unit capable of changing the length of the transport path is provided between the corona irradiation unit and the head. Therefore, by changing the length of the transport path and adjusting the length of the transport path to a length where the radical generated by the corona irradiation is deactivated, it is possible to suppress that a foreign material generated by polymerization of the radical attached to a nozzle forming surface and the ink component by static electricity adheres to the nozzle forming surface. That is, it is possible to prevent the radical generated by the corona irradiation from causing an ejection defect.

The recording device according to a second aspect of the present disclosure, further includes a control unit, and the corona irradiation unit is configured to change an output of the corona irradiation, the transport path length changing unit includes a roller around which the target recording medium is windable and a roller moving unit configured to change the length of the transport path by moving the roller, and the control unit controls the roller moving unit to move the roller according to the output, in the first aspect.

Although a deactivation time of the radical generated by the corona irradiation varies according to the output of the corona irradiation, according to the present aspect, the rollers can be automatically moved according to the output of the corona irradiation by the control of the control unit. Therefore, with a simple configuration such as moving the roller, even if the deactivation time of the radical changes according to the output of the corona irradiation, in response to the change, the foreign material generated by the polymerization of the radical attached to the nozzle forming surface and the ink component by static electricity can be appropriately prevented from adhering to the nozzle forming surface.

According to the recording device of a third aspect of the present disclosure, the control unit controls the roller moving unit to control an arrangement of the roller so that a radical attached to the surface by the corona irradiation is deactivated before reaching a position facing the head along with the transport of the target recording medium, according to a deactivation time of the radical which corresponds to the output, in the second aspect.

According to the present aspect, the roller is arranged according to the deactivation time of the radical corresponding to the output of the corona irradiation. Therefore, for example, when the output of the corona irradiation is increased in order to record with high recording quality, the radical can be appropriately deactivated before reaching the head by moving the roller by the control of the control unit so that the length of the transport path is automatically lengthened, even if the deactivation time of the radical becomes long. On the other hand, when enhancing productivity, by lowering the output of the corona irradiation and moving the roller so that the length of the transport path is automatically shortened by the control of the control unit, the productivity is effectively enhanced.

According to the recording device of a fourth aspect of the present disclosure, the control unit is configured to calculate the deactivation time of the radical from the output, and to control the arrangement of the roller based on the calculation result and a transport time from the corona irradiation unit to the head based on a transport speed of the target recording medium, in the third aspect.

According to the present aspect, the roller can be arranged based on the calculation result of the deactivation time according to the output and the transport time from the corona irradiation unit to the head based on the transport speed of the target recording medium. Therefore, even in a configuration having only a small storage capacity storage unit, the ejection defect caused by the radical that attaches to the nozzle forming surface by static electricity can be appropriately suppressed.

The recording device according a fifth aspect of the present disclosure further including a storage unit storing data related to the deactivation time of the radical based on the output and a transport time from the corona irradiation unit to the head based on a transport speed of the target recording medium, and the control unit controls the arrangement of the roller based on the data, in the third aspect.

According to the present aspect, the roller can be arranged based on the data related to the deactivation time of the radical based on the output of the corona irradiation unit and the transport time from the corona irradiation unit to the head based on the transport speed of the target recording medium. Therefore, the ejection defect caused by the radical that attaches to the nozzle forming surface by static electricity can be appropriately suppressed based on the data, without imposing a large operation load on the control unit.

According to the recording device of a sixth aspect of the present disclosure, the transport path length changing unit includes a roller around which the target recording medium is windable and a roller fixing unit configured to fix the roller at a plurality of positions, and the transport path length changing unit is configured to change the length of the transport path by changing a position at which the roller is fixed, in the first aspect.

According to the present aspect, the transport path length changing unit includes the roller fixing unit capable of fixing the roller at a plurality of positions. Therefore, the transport path can be changed to a plurality of lengths while keeping the number of roller small.

According to the recording device of a seventh aspect of the present disclosure, the transport path length changing unit includes a plurality of rollers around which the target recording medium is windable, and the transport path length changing unit is configured to change the length of the transport path by changing the rollers around which the target recording medium is wound, in the first aspect.

According to the present aspect, the transport path length changing unit includes the plurality of rollers around which the target recording medium is windable, and is capable of changing the length of the transport path by changing the rollers around which the target recording medium is wound. Therefore, the transport path can be changed to a plurality of lengths without causing the user to take time of changing the positions of the rollers.

A recording method according to an eight aspect of the present disclosure is a recording method in a recording device including a feeding unit configured to feed out a target recording medium while supporting the target recording medium in a roll form, a head configured to eject ink to a surface of the target recording medium fed from the feeding unit, thereby forming an image on the surface, a corona irradiation unit arranged between the feeding unit and the head in a transport path of the target recording medium and configured to modify the surface by performing corona irradiation, the recording method including changing a length of the transport path between the corona irradiation unit and the head according to an output of the corona irradiation unit, and subsequently transporting the target recording medium and forming an image by the head.

According to the present aspect, after the length of the transport path between the corona irradiation unit and the head is changed, the target recording medium is transported and the image is formed by the head. Therefore, by changing the length of the transport path and adjusting the length of the transport path to the length in which the radical generated by the corona irradiation is deactivated, it is possible to suppress that a foreign material generated by the polymerization of the radical and the ink component attached to the nozzle forming surface by static electricity adheres to the nozzle forming surface. That is, it is possible to prevent the radical generated by the corona irradiation from causing ejection defects.

Preferred embodiments of the present disclosure will be described below with reference to the accompanying drawings.

EXAMPLE 1

A recording device 1 according to Example 1 of the present disclosure will be described below with reference to FIGS. 1 to 6. First, an outline of the recording device 1 according to the present example will be described with reference to FIG. 1.

Figure 2:
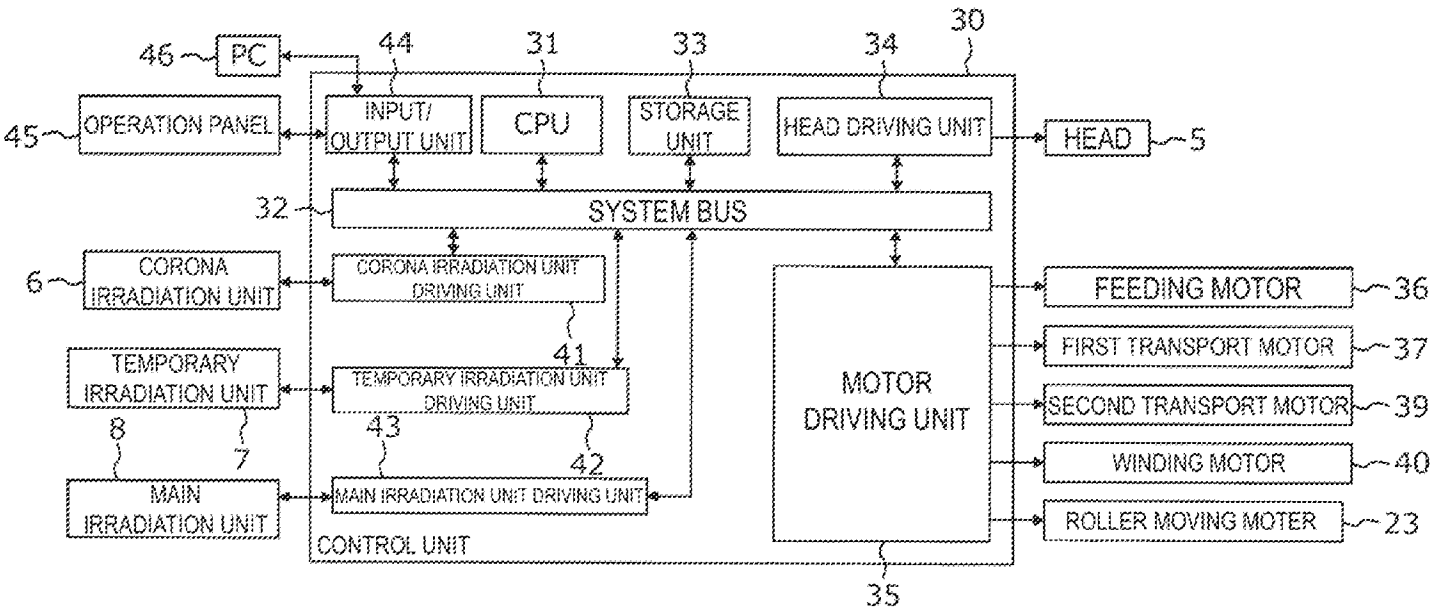
FIG. 2 is a block diagram illustrating an electrical configuration of the recording device according to Example 1 of the present disclosure.

The recording device 1 of the present example is a recording device that records an image on a target recording medium M such as paper, cloth, and film, and is communicably connected to a computer which is an external device represented by a PC 46 in FIG. 2. As illustrated in FIG. 1, the recording device 1 of the present example is configured to record on the target recording medium M which is wound in a roll form.

As illustrated in FIG. 1, the recording device 1 of the present example includes a feeding unit 2 capable of feeding out the target recording medium M by setting the target recording medium M which is in a roll form and rotating it in a rotation direction C. The target recording medium M is fed to a first transport roller pair 9 by the feeding unit 2. The feeding unit 2 includes a rotary shaft that supports a winding shaft of the target recording medium M which is in a roll form and that rotates in the rotation direction C. Then, the target recording medium M fed out from the feeding unit 2 is transported in a transport direction A by the first transport roller pair 9.

The target recording medium M transported by the first transport roller pair 9 reaches a transport drum 3 as a support portion of the target recording medium M, via a corona irradiation unit 6 that modifies a surface of the target recording medium M by irradiating the target recording medium M with corona, a transport path length changing unit 20 capable of changing a length of a transport path of the target recording medium M, and further, a relay roller 10. Then, the target recording medium M is transported in close contact with the transport drum 3 that rotates in the rotation direction C.

Here, the corona irradiation unit 6 can change the output by user's instruction via an operating panel 45, the PC 46, and the like illustrated in FIG. 2. By changing the output, modification degree of the surface of the target recording medium M can be changed. By increasing the output, the modification degree of the surface of the target recording medium M increases, and by lowering the output, the modification degree of the surface of the target recording medium M decreases. The transport path length changing unit 20 is described in detail later.

At a position facing the transport drum 3, four head units 21 including a head 5 that ejects ultraviolet curing type ink and a temporary irradiation unit 7 provided with an ultraviolet irradiation unit that irradiates ultraviolet rays from LEDs for temporary curing are formed. Specifically, as the head units 21, a head unit 21*a* including a head 5*a* corresponding to cyan ink and a temporary irradiation unit 7*a*, a head unit 21*b* including a head 5*b* corresponding to magenta ink and a temporary irradiation unit 7*b*, a head unit 21*c* including a head 5*c* corresponding to yellow ink and a temporary irradiation unit 7*c*, and a head unit 21*d* including a head 5*d* corresponding to black ink and a temporary irradiation unit 7*d* are formed. Further, in the position facing the transport drum 3, a main irradiation unit 8 is formed downstream of the four head units 21 in the transport direction A as an ultraviolet irradiation unit that mainly cures the ultraviolet curing type ink. The head unit 21*a*, the head unit 21*b*, the head unit 21*c*, and the head unit 21*d* all have the same shape.

By modifying the surface by the corona irradiation unit 6, quality of the image formed on the target recording medium M by the head unit 21 is improved. Generally, the higher the degree of the surface modification of the recording medium M, the better the recording quality. Further, as described above, the corona irradiation unit 6 of the present example is configured to modify a state of the surface of the target recording medium M into a plurality of modification states by changing the output, and thus can modify the state of the surface of the target recording medium M into the plurality of modification states according to a recording quality requested by the user.

By the four head units 21, an image is formed on the target recording medium M that is transported in close contact with the transport drum 3. Then, as the ink forming the image is mainly cured by the main irradiation unit 8, the image formed on the target recording medium M by the four head units 21 is fixed on the target recording medium M. In the recording device 1 of the present example, irradiation intensity of the ultraviolet rays from the main irradiation unit 8 is stronger than irradiation intensity of the ultraviolet rays from the temporary irradiation unit 7. In other words, in the recording device 1 of the present example, ink ejected to the target recording medium M is temporarily cured by the ultraviolet irradiation from the temporary irradiation unit 7 to prevent the ink from spreading too much, and the ink is cured by the ultraviolet irradiation from the main irradiation unit 8 and fixed on the target recording medium M.

Further, a tension roller 11 is provided downstream of the main irradiation unit 8 in the transport direction A, and the target recording medium M is transported from the transport drum 3 to a second transport roller pair 12 via the tension roller 11. Then, the target recording medium M transported by the second transport roller pair 12 is wound into a roll form by rotating a winding unit 4 in the rotation direction C.

Here, each of the heads 5 in the recording device 1 of the present example is a line head in which nozzles are formed in a line shape along a width direction B of the target recording medium M on a nozzle forming surface. That is, the recording device 1 of the present example is a so-called line printer that continuously records while continuously transporting the target recording medium M. However, the recording device 1 may be a printer including a head that ejects ink while reciprocating in a direction intersecting the transport direction A.

Next, an electrical configuration of the recording device 1 according to the present example will be described with reference to FIG. 2.

A control unit 30 is provided with a CPU 31 that controls the entire recording device 1. The CPU 31 is connected through the system bus 32 to a storage unit 33 including a ROM storing various control programs and the like executed by the CPU 31, a RAM and an EEPROM which can temporarily store data, and the like. Here, in the storage unit 33, data representing a relationship between a deactivation time of a radical based on the output of the corona irradiation unit 6 and an appropriate transport time from the corona irradiation unit 6 to the head 5 based on a transport speed of the target recording medium M, according to the transport path length from the corona irradiation unit 6 to the head 5 (specifically, the head 5*a* which is at the shortest distance), is stored.

Further, the CPU 31 is connected through the system bus 32 to a head driving unit 34 for driving the head 5 and ejecting the ink.

Furthermore, the CPU 31 is connected through the system bus 32 to a motor driving unit 35, and the motor driving unit 35 is connected to a feeding motor 36, a first transport motor 37, a second transport motor 39, a winding motor 40, and a roller moving motor 23. Here, the feeding motor 36 is a rotation mechanism of the rotary shaft of the feeding unit 2, and is a motor that drives the feeding unit 2 in order to feed the target recording medium M to the first transport motor 37. Further, the first transport motor 37 is a motor for driving the first transport roller pair 9. Further, the second transport motor 39 is a motor for driving the second transport roller pair 12. Further, the winding motor 40 is a motor that drives the winding unit 4 in order to wind the target recording medium M into a roll form. Then, the roller moving motor 23 is a motor for changing arrangements of a second roller 22B and a fourth roller 22D provided in the transport path length changing unit 20.

Further, the CPU 31 is connected through the system bus 32 to a corona irradiation unit driving unit 41 for driving the corona irradiation unit 6 to modify the surface of the target recording medium M. Further, the CPU 31 is connected through the system bus 32 to a temporary irradiation unit driving unit 42 for driving the temporary irradiation unit 7 to irradiate the target recording medium M with ultraviolet rays. Further, the CPU31 is connected to through the system bus 32 to a main irradiation unit driving unit 43 for driving the main irradiation unit 8 to irradiate the target recording medium M with ultraviolet rays.

Further, the CPU 31 is connected thorough the system bus 32 to the operating panel 45 capable of receiving instructions from the user and the like such as data input by the user, the PC 46 for transmitting and receiving data such as image data and a signal, and the like, through an input-output unit 44.

Next, the transport path length changing unit 20 which is a main part of the recording device 1 of the present example will be described in detail with reference to FIGS. 3 to 6. Here, FIG. 3 illustrates a portion, from a front side of constituents of the transport path length changing unit 20 to a front side of constituents of the second transport roller pair 12, in the transport path of the target recording medium M, and some constituents such as the head unit 21 and the irradiation unit 8 are omitted in order to facilitate understanding of the inner configuration.

As illustrated in FIG. 1, the recording device 1 of the present example includes the transport path length changing unit 20 in a region between the corona irradiation unit 6 and the transport drum 3 in the transport path of the target recording medium M. Further, as illustrated in FIGS. 3 to 6, the transport path length changing unit 20 includes a plurality of rollers 22, specifically, a first roller 22A, the second roller 22B, a third roller 22C, the fourth roller 22D, and a fifth roller 22E. As illustrated in FIGS. 1 and 4 to 6, the target recording medium M sent from the feeding unit 2 to the transport drum 3 is wound around the first roller 22A, the second roller 22B, the third roller 22C, the fourth roller 22D, and the fifth roller 22E in this order inside the transport path length changing unit 20.

Figure 3:
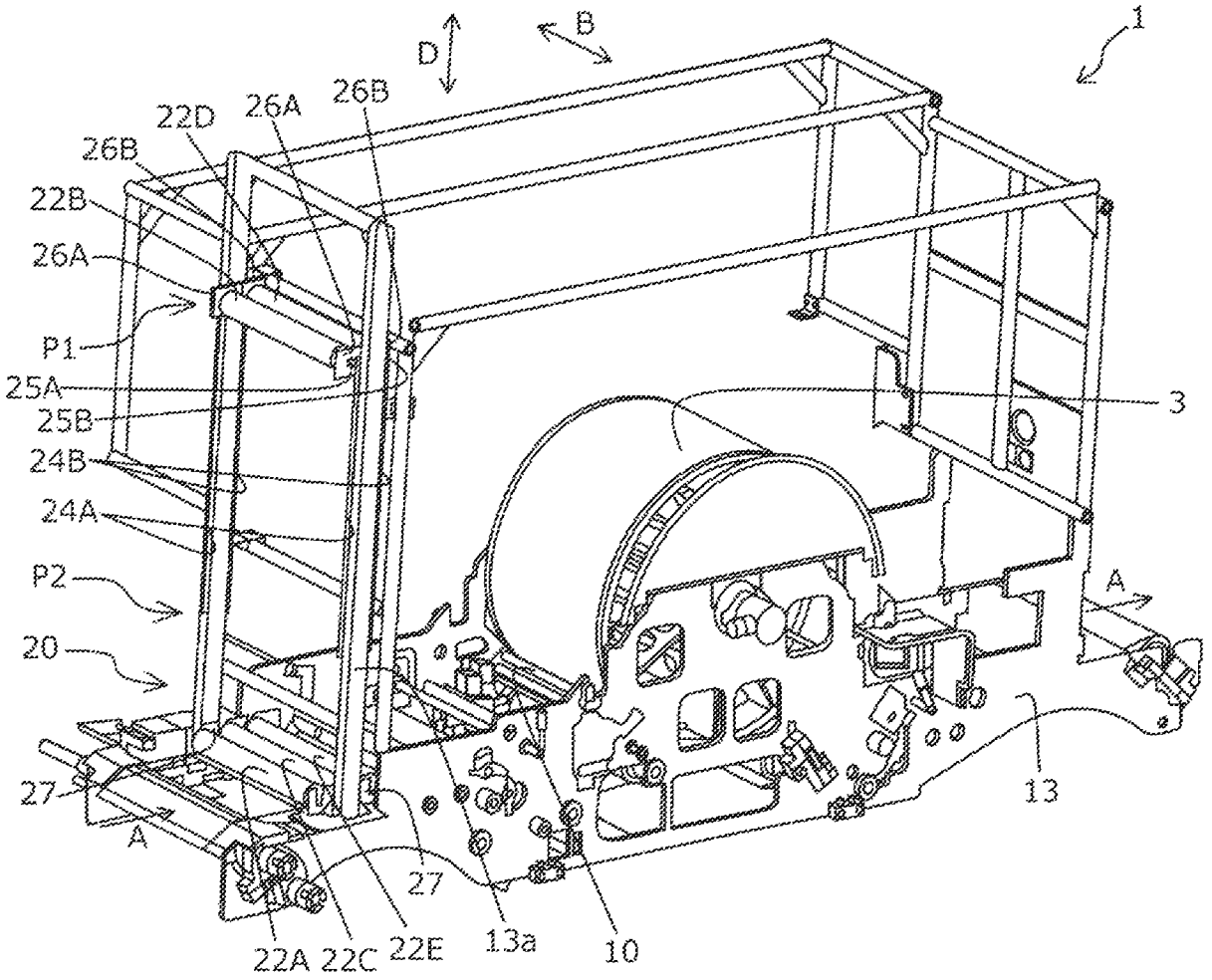
FIG. 3 is a perspective view illustrating a periphery of the recording device according to Example 1 of the present disclosure.

Here, as illustrated in FIG. 3, of the first roller 22A, the second roller 22B, the third roller 22C, the fourth roller 22D, and the fifth roller 22E, the second roller 22B is attached to an upper support unit 26, the fourth roller 22D is attached to an upper support unit 26B, and the first roller 22A, the third roller 22C, and the fifth roller 22E are attached to a lower fixed support unit 27. The lower fixed support unit 27 is fixed to a base 13. On the other hand, the upper support unit 26A meshes with a rack 25A that is formed at a column portion 13*a* of the base 13 and that is provided with a pinion 24A to which driving force of the roller moving motor 23 is transmitted, and the upper support unit 26A is movable in a moving direction D corresponding to a vertical direction with respect to the column portion 13*a*. Similarly, the upper support unit 26B meshes with a rack 25B that is formed at the column portion 13*a* of the base 13 and that is provided with a pinion 24B to which the driving force of the roller moving motor 23 is transmitted, and the upper support unit 26B is movable in the moving direction D corresponding to the vertical direction with respect to the column portion 13*a*, as well.

That is, the recording device 1 of the present example is configured to individually move the second roller 22B and the fourth roller 22D in the moving direction D. With such a configuration, by individually changing a distance of the second roller 22B to the first roller 22A and the third roller 22C and a distance of the fourth roller 22D to the third roller 22C and the fifth roller 22E, the transport path length of the target recording medium M in the transport path length changing unit 20 can be changed.

Figure 4:
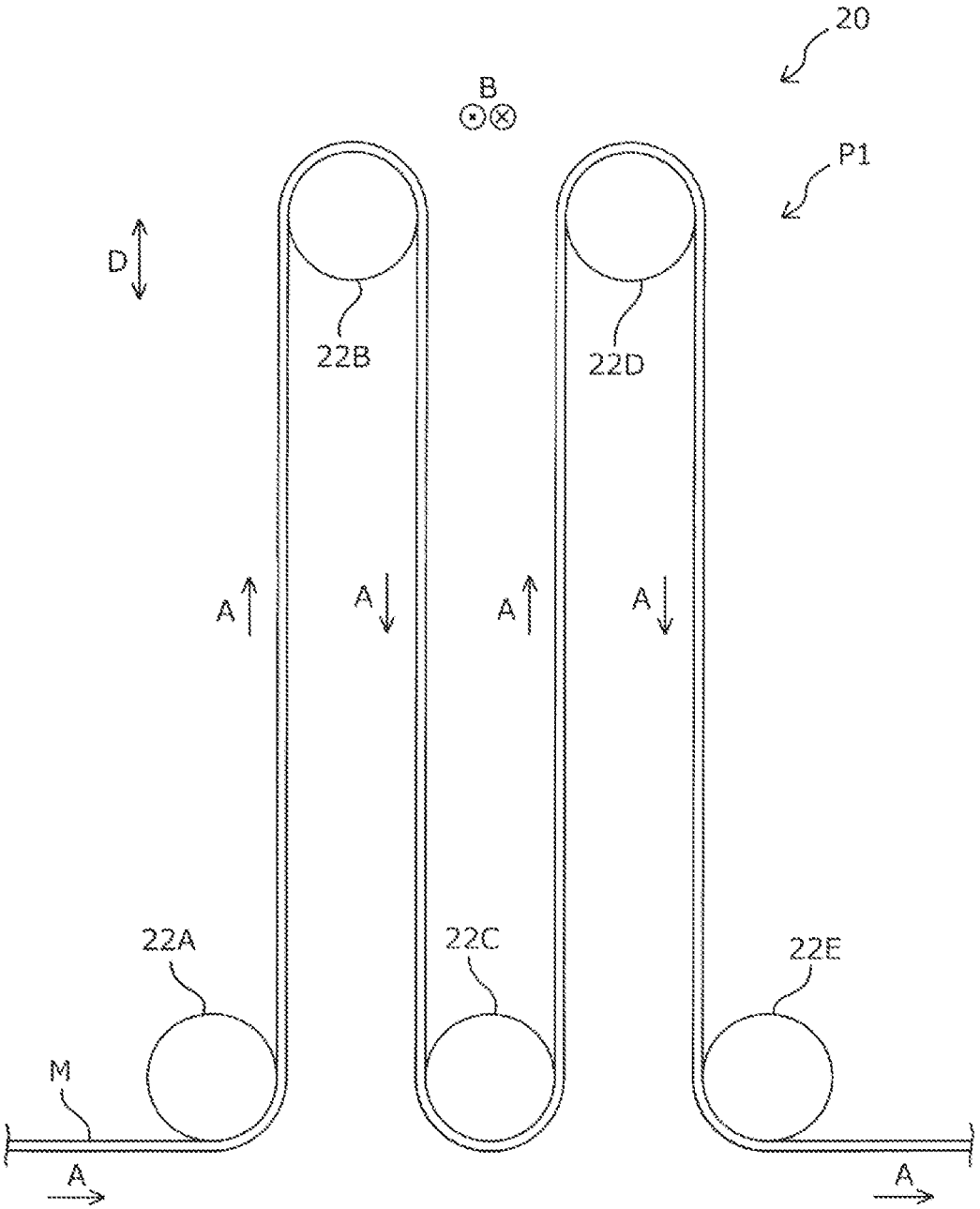
FIG. 4 is a schematic view illustrating a state in which a transport path length is maximized in the recording device according to Example 1 of the present disclosure.
Figure 5:
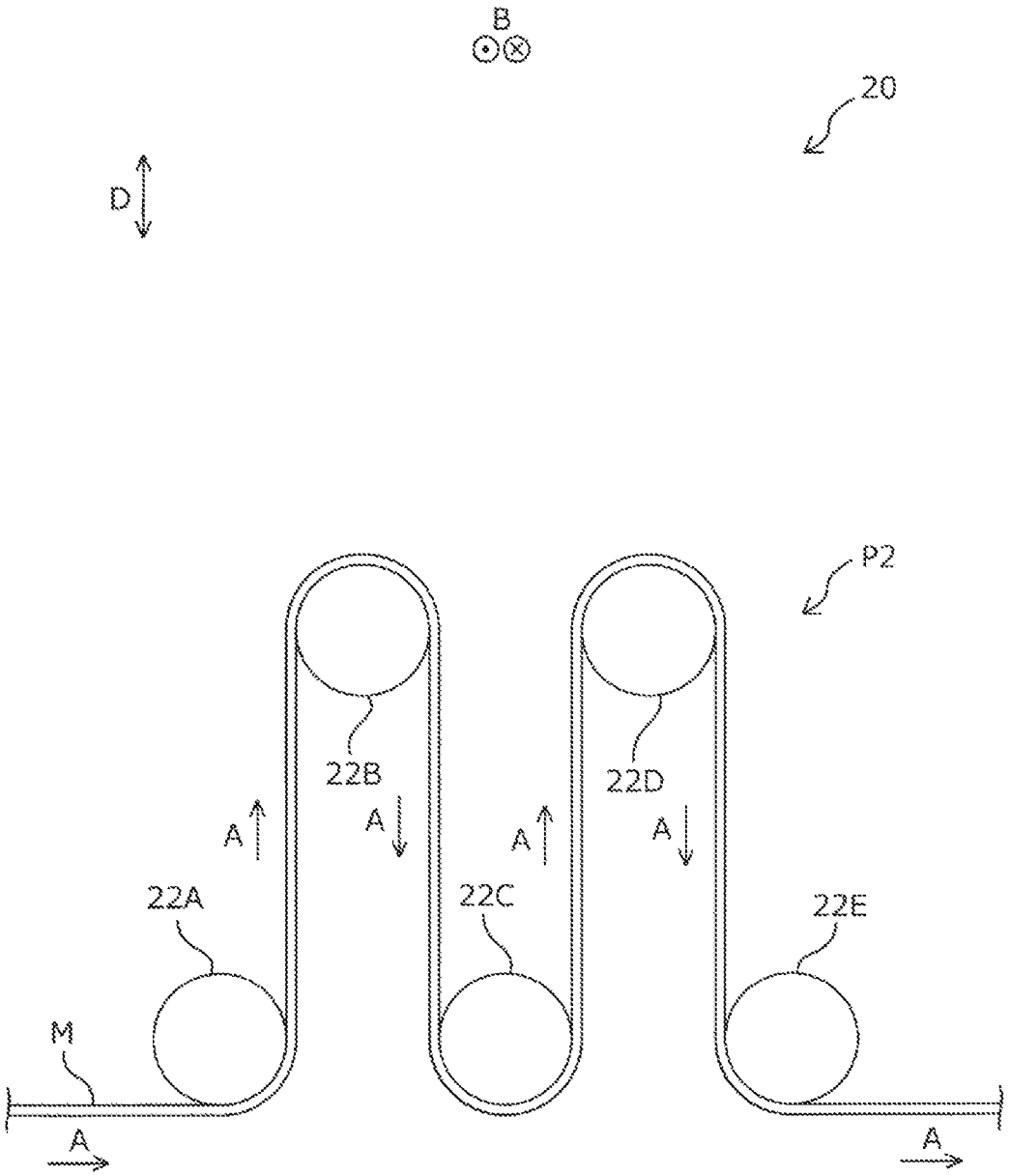
FIG. 5 is a schematic view illustrating a state in which the transport path length is minimized in the recording device according to Example 1 of the present disclosure.
Figure 6:
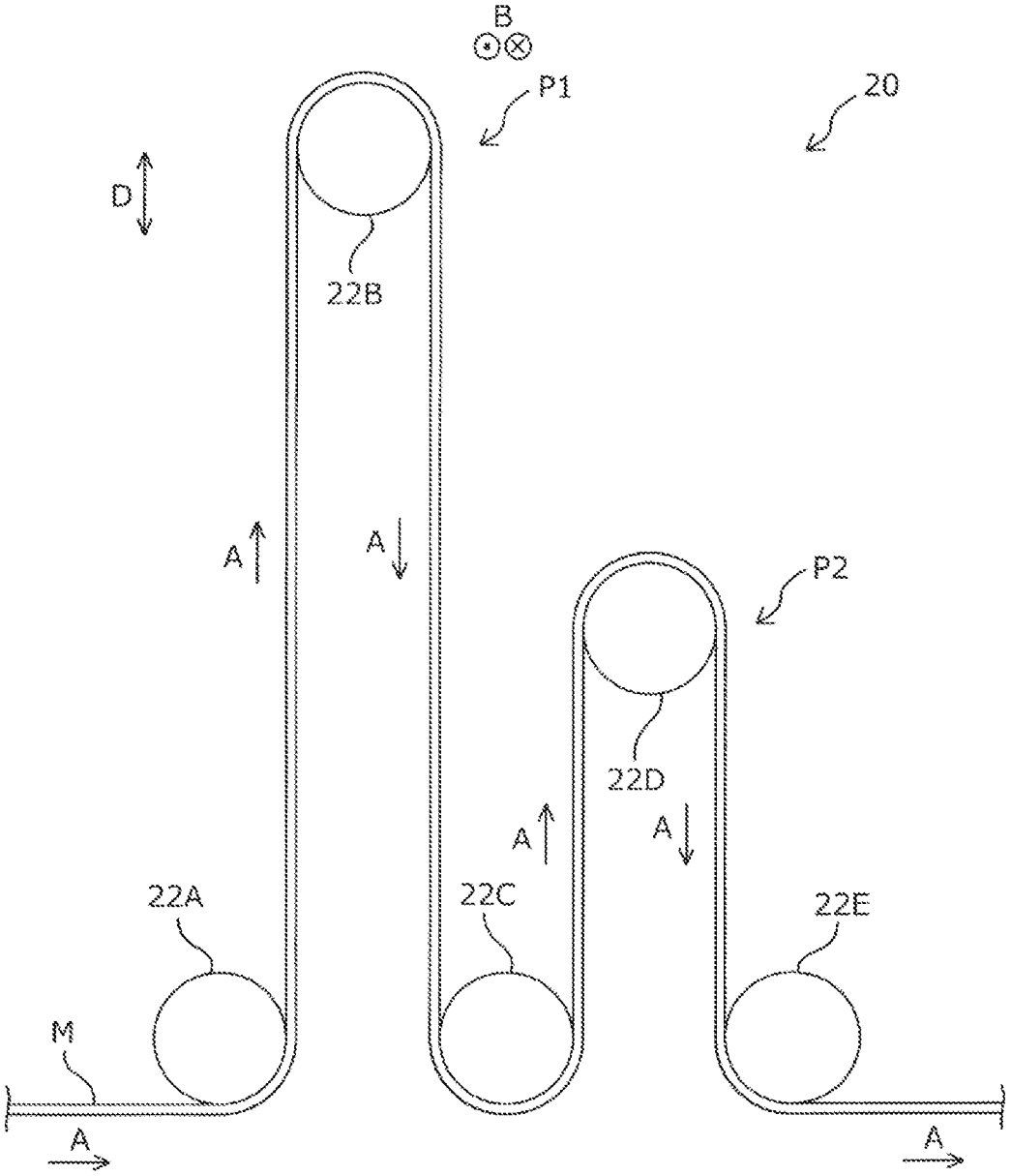
FIG. 6 is a schematic view illustrating a state in which the transport path length is intermediate in the recording device according to Example 1 of the present disclosure.

In the recording device 1 of the present example, the upper support unit 26A and the upper support unit 26B, that is, the second roller 22B and the fourth roller 22D are both movable individually in a range from an uppermost position P1 to a lowermost position P2 freely. FIG. 4 illustrates a state in which both the second roller 22B and the fourth roller 22D are located at the uppermost position P1 and the transport path length of the target recording medium M is maximized. Further, FIG. 5 illustrates a state in which both the second roller 22B and the fourth roller 22D are located at the lowermost position P2 and the transport path length of the target recording medium M is minimized. Further, FIG. 6 illustrates a state in which the second roller 22B is located at the uppermost position P1 and the fourth roller 22D is located at the lowermost position P2, and the transport path length of the target recording medium M is intermediate between those of the states illustrated in FIGS. 4 and 5. The recording device 1 of the present example can be in a state other than the states illustrated in FIGS. 4 to 6, and the second roller 22B and the fourth roller 22D can be individually arranged at positions between the uppermost position P1 and the lowermost position P2.

Here, in summary, the recording device 1 according to the present example includes, as illustrated in FIG. 1, the feeding unit 2 that feeds out the target recording medium M while supporting target recording medium M in a roll form, the head 5 that ejects the ink to the surface of the target recording medium M fed from the feeding unit 2, thereby forming an image on the surface, and the corona irradiation unit 6 that is arranged between the feeding unit 2 and the head 5 in the transport path of the target recording medium M and that modifies the surface of the target recording medium M by corona irradiation. Then, the transport path length changing unit 20 is provided between the corona irradiation unit 6 and the head 5 in the transport path of the target recording medium M, and the transport path length changing unit 20 is configured to change the length of the transport path of the target recording medium M.

Radicals are generated when performing corona irradiation from the corona irradiation unit 6, but the radicals generated by the corona irradiation are deactivated after a predetermined time. As described above, the recording device 1 of the present example includes the transport path length changing unit 20 configured to change the length of the transport path of the target recording medium M, between the corona irradiation unit 6 and the head 5 in the transport path of the target recording medium M. Therefore, by changing the length of the transport path of the target recording medium M and adjusting the length of the transport path to the length in which the radical generated by the corona irradiation is deactivated, the recording device 1 of the present example can prevent a foreign material generated by the polymerization of the radical and the ink component attached to the nozzle forming surface by static electricity from adhering to the nozzle forming surface. That is, the recording device 1 of the present example can prevent the radical generated by the corona irradiation from causing ejection defects. The ejection defect due to the radical is proportional to the output of the corona irradiation and is inversely proportional to the length of the transport path of the target recording medium M.

Further, the recording device 1 of the present example includes the control unit 30 as described above. Further, the corona irradiation unit 6 can change the output of the corona irradiation. Further, the transport path length changing unit 20 includes the plurality of rollers 22 around which the target recording medium M can be wound, and the roller moving motor 23, the pinion 24A, the rack 25A, the pinion 24B, and the rack 25B as the roller moving unit capable of changing the length of the transport path of the target recording medium M by moving the second roller 22B and the fourth roller 22D of the rollers 22. Here, the control unit 30 can control, according to the output of the corona irradiation, the roller moving unit so that the length of the transport path of the target recording medium M becomes a desired length, and move the second roller 22B and the fourth roller 22B to desired positions.

Although the deactivation time of the radical generated by the corona irradiation varies according to the output of the corona irradiation, the recording device 1 of the present example can automatically move the second roller 22B and the fourth roller 22D to the desired positions by the control of the control unit 30. Therefore, with a simple configuration such as moving the roller 22, the recording device 1 of the present example can suppress that the foreign material generated by the polymerization of the radical and the ink component attached to the nozzle forming surface by static electricity adheres to the nozzle forming surface, even if the deactivation time of the radical varies according to the output of the corona irradiation.

Describing the above from a viewpoint of a recording method, by using the recording device 1 according to the present example including the feeding unit 2 that feeds out the target recording medium M while supporting target recording medium M in a roll form, the head 5 that ejects the ink to the surface of the target recording medium M fed from the feeding unit 2 and thereby forming an image on the surface, and the corona irradiation unit 6 that is arranged between the feeding unit 2 and the head 5 in the transport path of the target recording medium M and that modifies the surface of the target recording medium M by corona irradiation, a recording method including changing the length of the transport path of the target recording medium M between the corona irradiation unit 6 and the head 5, and then transporting the target recording medium M and forming an image by the head 5 can be performed. The recording method transports the target recording medium M to form an image thereon by the head 5, after changing the transport path length of the target recording medium M between the corona irradiation unit 6 and the head 5. By performing the recording method, that is, by changing the length of the transport path of the target recording medium M and adjusting it to the length of the transport path in which the radical generated by the corona irradiation is deactivated, it is possible to prevent a foreign material generated by the polymerization of the radical and the ink component attached to the nozzle forming surface by static electricity along with the recording from adhering to the nozzle forming surface. That is, by performing the recording method, it is possible to prevent the radical generated by the corona irradiation from causing ejection defects.

Here, in the recording device 1 of the present example, the control unit 30 controls the roller moving unit to control the arrangements of the second roller 22B and the fourth roller 22D so that the radical attached to the surface of the target recording medium M due to the corona irradiation by the corona irradiation unit 6 is deactivated before reaching a position facing the head 5 (specifically, the head 5*a* at the shortest distance) along with the transport of the target recording medium M, according to a deactivation time of the radical which corresponds to the output of the corona irradiation. That is, the recording device 1 according to the present embodiment arranges the rollers 22 according to the deactivation time of the radical corresponding to the output of the corona irradiation. Therefore, for example, when the output of the corona irradiation is increased in order to record with high recording quality, the radical is appropriately deactivated before reaching the head 5 by moving the second roller 22B and the fourth roller 22D by the control of the control unit 30 so that the length of the transport path of the target recording medium M is automatically lengthened, even if the deactivation time of the radical becomes long. On the other hand, when the recording time from the start to the end of recording is shortened in order to enhance productivity, by lowering the output of the corona irradiation and moving the second roller 22B and the fourth roller 22D so that the length of the transport path of the target recording medium M is automatically shortened by the control of the control unit 30, the recording time is effectively shortened.

More specifically, in the recording device 1 of the present example, data related to the deactivation time of the radical based on the output of the corona irradiation and the transport time from the corona irradiation unit 6 to the head 5 based on the transport speed of the target recording medium M is stored in the storage unit 33. Then, the control unit 30 controls the arrangement of the second roller 22B and the fourth roller 22D based on the data stored in the storage unit 33. With such a configuration, the recording device 1 of the present embodiment can appropriately suppress the ejection defect caused by the radical based on the data, without imposing a large operation load on the control unit 30.

However, the above-described configuration is not intended to result in limitation. The control unit 30 may be configured to calculate the deactivation time of the radical from the output of the corona irradiation, and to control the arrangement of the rollers 22 based on the calculation result and the transport time from the corona irradiation unit 6 to the head 5 based on the transport speed of the target recording medium M. With such a configuration, for example, even if the recording device 1 has only a small storage capacity storage unit, the ejection defect caused by the radical can be suppressed appropriately, without storing arrangement data of the rollers 22 corresponding to the deactivation time of the radical in the storage unit 33.

EXAMPLE 2

(FIG. 7)

Figure 7:
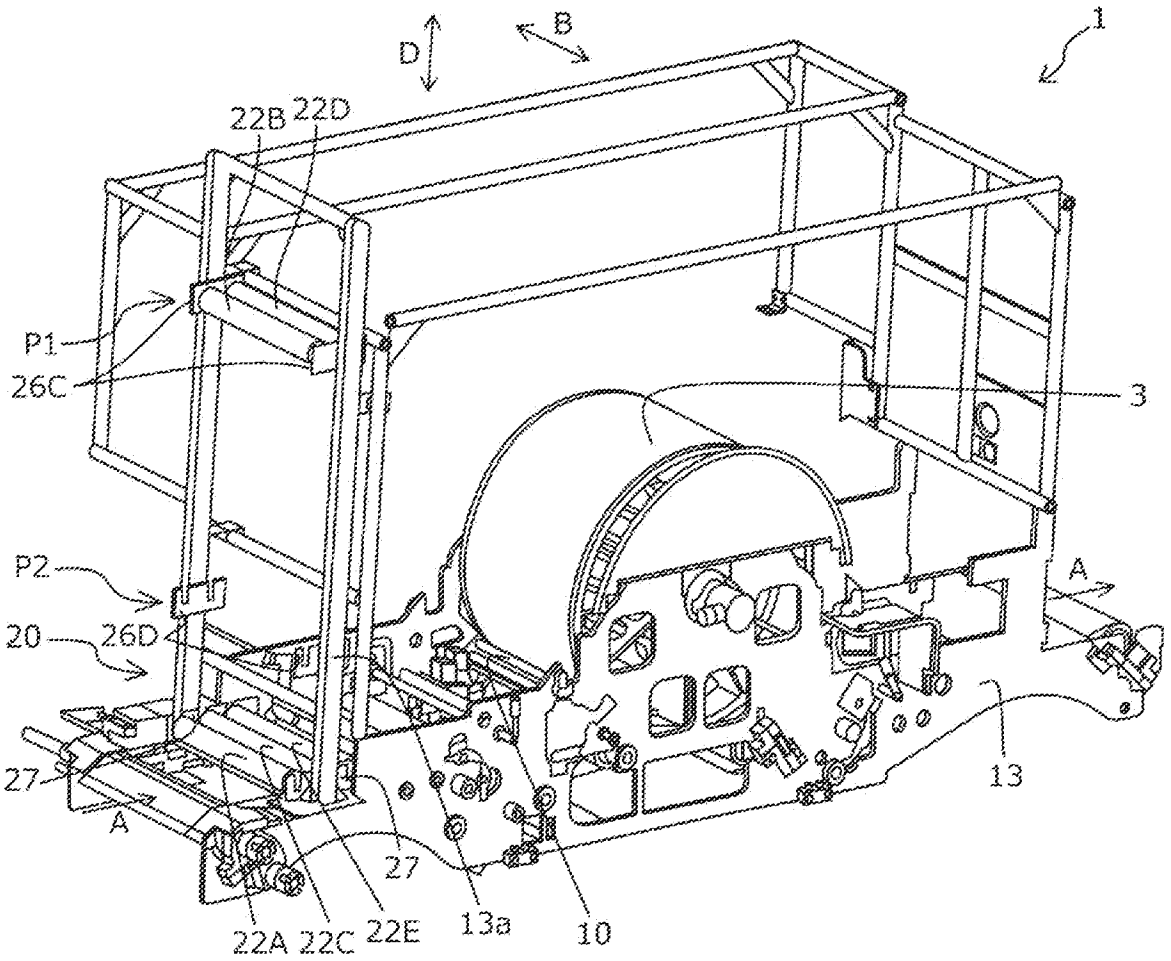
FIG. 7 is a perspective view illustrating a periphery of a transport path length changing unit of a recording device according to Example 2 of the present disclosure.

Next, a recording device 1 according to Example 2 will be described with reference to FIG. 7. FIG. 7 is a perspective view illustrating a periphery of a transport path length changing unit 20 of the recording device 1 according to Example 2 of the present disclosure, which corresponds to FIG. 3 of Example 1. Note that the constituent members common to those in Embodiment 1 described above are denoted by the same reference numerals, and the detailed description will be omitted. The recording device 1 according to the present example has a configuration similar to that of the recording device 1 according to Example 1 except for the configuration of the transport path length changing unit 20 and controlling measures thereof.

As described above, the recording device 1 of Example 1 is configured so that the second roller 22B and the fourth roller 22D can be automatically moved to desired positions by the control of the controlling unit 30 according to the output of the corona irradiation. On the other hand, in the recording device 1 of the present embodiment, the transport path length changing unit 20 is simplified and the cost thereof is reduced as compared with the recording device 1 of Example 1, and the positions of the second roller 22B and the fourth roller 22D are changed manually by the user.

As illustrated in FIG. 7, the recording device 1 according to the present example includes an upper support unit 26C capable of attaching the second roller 22B and the fourth roller 22D at the uppermost position P1, and a lower support unit 26D capable of attaching the second roller 22B and the fourth roller 22D at the lowermost position P2 in the transport path length changing unit 20. Both the upper support unit 26C and the lower support unit 26D are fixed to the column portion 13*a* of the base 13. The user can adjust the transport path length of the target recording medium M in the transport path length changing unit 20 depending on whether the second roller 22B and the fourth roller 22D are attached to the upper support unit 26C or the lower support unit 26D. Further, the attachment position of the second roller 22B and the fourth roller 22D is not limited to the upper support unit 26C and the lower support unit 26D, and the second roller 22B and the fourth roller 22D may be configured to be attachable at any position between the upper support unit 26C and the lower support unit 26D.

That is, the transport path length changing unit 20 of the recording device 1 of the present example includes the rollers 22 around which the target recording medium M can be wound, and the upper support unit 26C and the lower support unit 26D as a roller fixing unit that can fix the second roller 22B and the fourth roller 22D of the rollers 22 at a plurality of positions. Further, the upper support unit 26C and the lower support unit 26D can change the length of the transport path of the target recording medium M by changing the position at which the second roller 22B and the fourth roller 22D are fixed. Therefore, the recording device 1 of the present example can change the transport path of the target recording medium M to a plurality of lengths while keeping the number of rollers 22 small with a simple configuration. The roller fixing unit fixes the rollers 22 means that the rollers 22 are fixed so as not to move while being supported in a rotatable state.

As in the recording device 1 of Example 1, in the recording device 1 of the present example, a state in which the second roller 22B and the fourth roller 22D are both located at the uppermost position P1 and the transport path length of the target recording medium M is maximized can be illustrated as FIG. 4. Further, a state in which the second roller 22B and the fourth roller 22D are both located at the lowermost position P2 and the transport path length of the target recording medium M is minimized can be illustrated as FIG. 5. Further, a state in which the second roller 22B is located at the uppermost position P1 and the fourth roller 22D is located at the lowermost position P2, and the transport path length of the target recording medium M is intermediate between those of the states illustrated in FIGS. 4 and 5 can be illustrated as FIG. 6.

EXAMPLE 3

(FIGS. 8 to 11)

Figure 8:
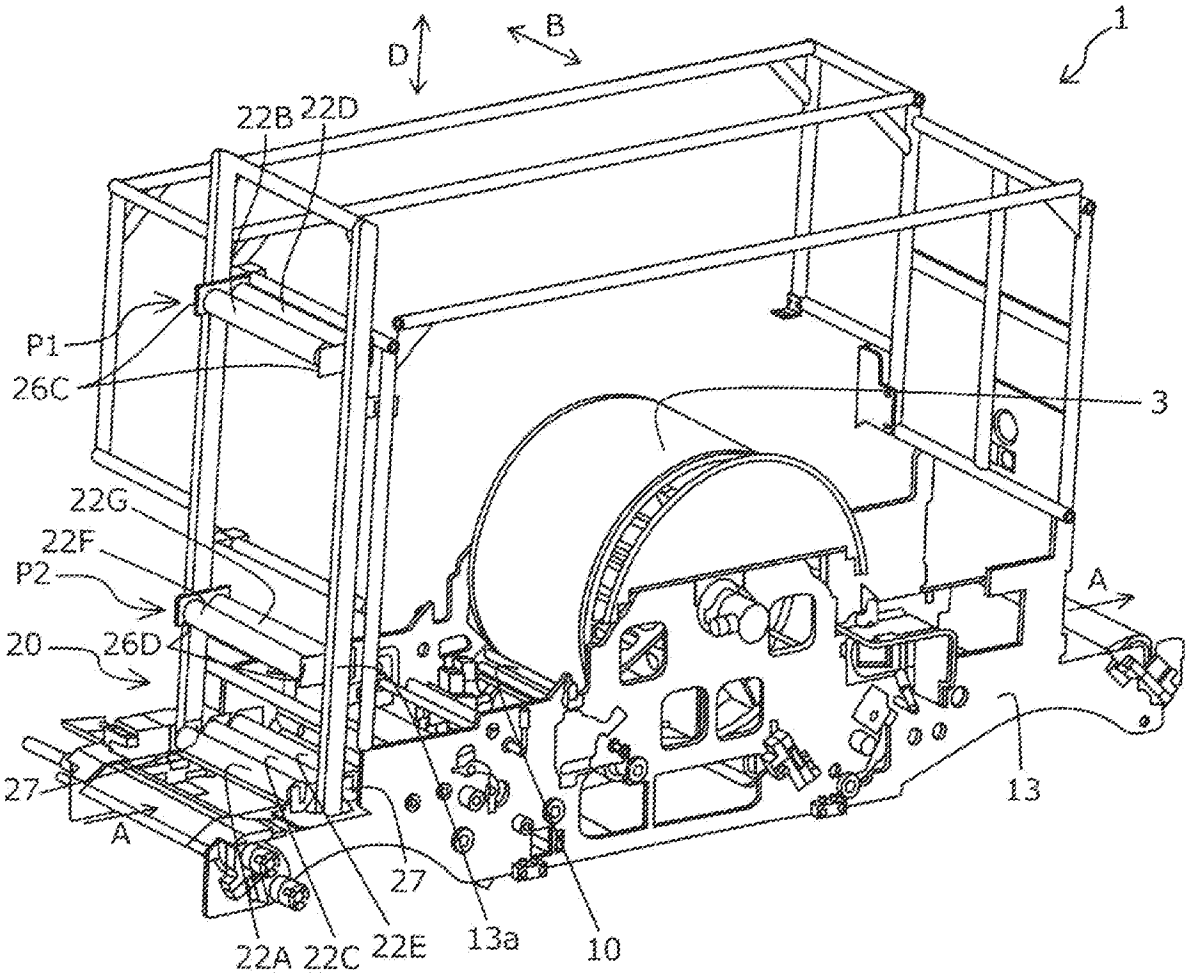
FIG. 8 is a perspective view illustrating a periphery of a transport path length changing unit of a recording device according to Example 3 of the present disclosure.
Figure 9:
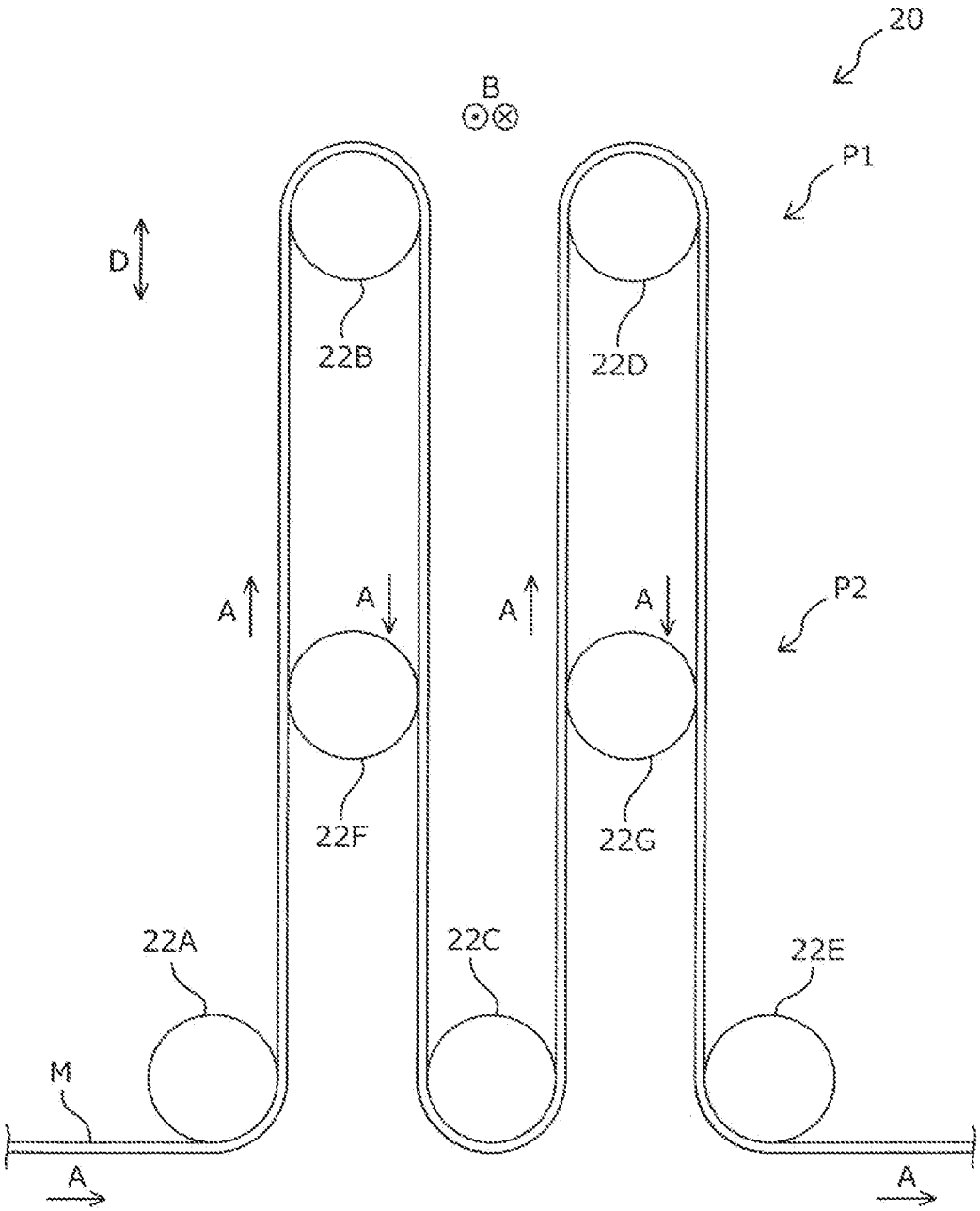
FIG. 9 is a schematic view illustrating a state in which a transport path length is maximized in the recording device according to Example 3 of the present disclosure.
Figure 10:
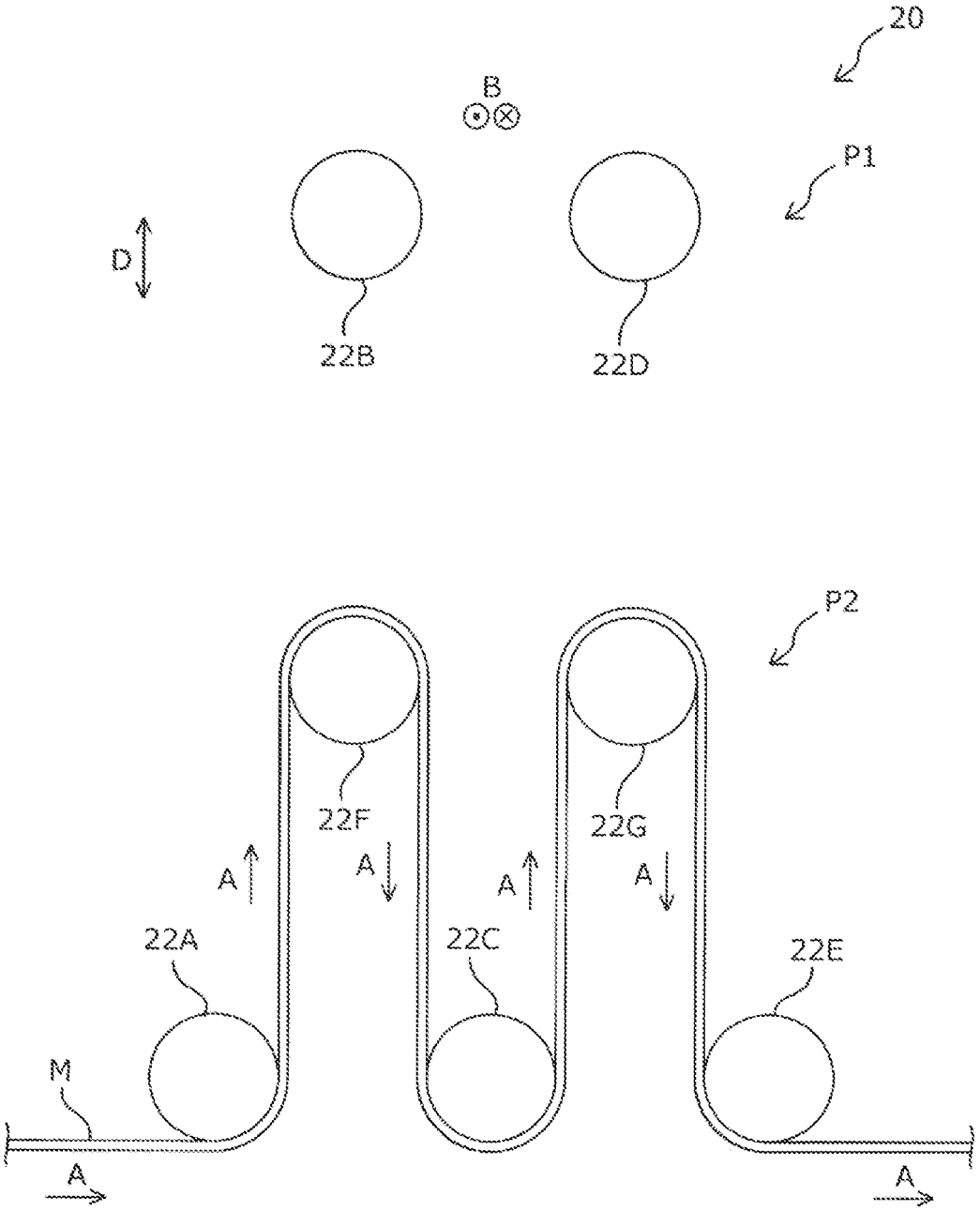
FIG. 10 is a schematic view illustrating a state in which the transport path length is minimized in the recording device according to Example 3 of the present disclosure.
Figure 11:
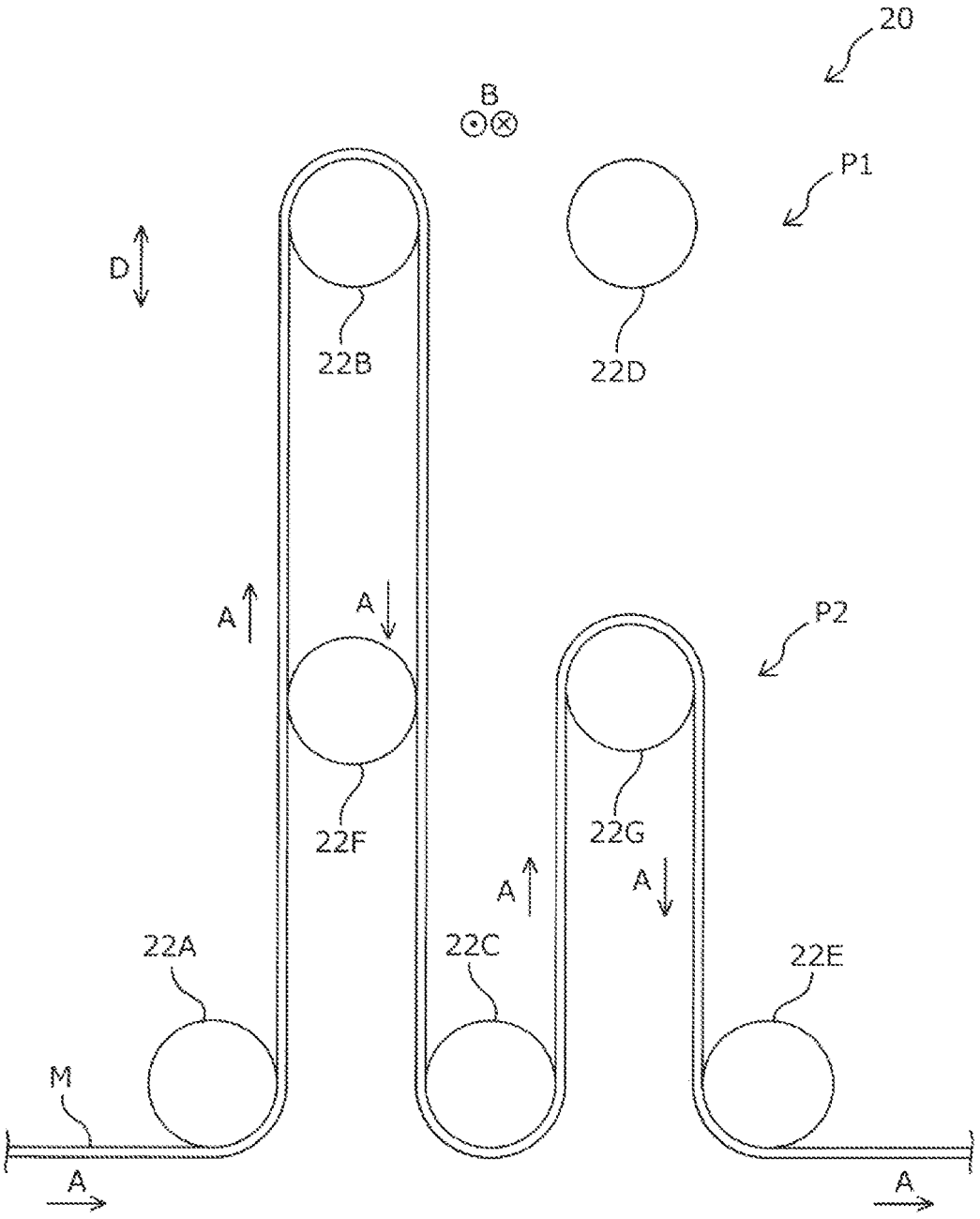
FIG. 11 is a schematic view illustrating a state in which the transport path length is intermediate in the recording device according to Example 3 of the present disclosure.

Next, a recording device 1 according to Example 3 will be described with reference to FIGS. 8 to 11. Here, FIG. 8 is a perspective view illustrating a periphery of a transport path length changing unit 20 of the recording device 1 according to Example 3 of the present disclosure, which corresponds to FIG. 3 of Example 1. FIGS. 9 to 11 correspond to FIGS. 4 to 6 of Example 1. Like numbers designate identical or corresponding component elements in the examples 1 and 2, described above, and detailed description for such component elements are omitted. The recording device 1 of the present example has the same configuration as the recording device 1 of Example 2 except that the rollers 22 are provided at both the upper support unit 26C and the lower support unit 26D.

The recording device 1 of Example 2 is configured so that the length of the transport path of the target recording medium M can be changed depending on whether the second roller 22B and the fourth roller 22D are attached to either the upper support unit 26C provided at the uppermost position P1 or the lower support unit 26D provided at the lowermost position P2. On the other hand, as illustrated in FIG. 8, in the recording device 1 according to the present example, the second roller 22B and the fourth roller 22D are attached to the upper support unit 26C provided at the uppermost position P1, and a sixth roller 22F and a seventh roller 22G are attached to the lower support unit 26D provided at the lowermost position P2.

That is, the transport path length changing unit 20 of the recording device 1 according to the present example includes the plurality of rollers 22 around which the target recording medium M can be wound, and is capable of changing the length of the transport path of the target recording medium M by changing the rollers 22 around which the target recording medium M is wound. Therefore, the recording device 1 of the present example can change the transport path of the target recording medium M to a plurality of lengths without causing the user to take time of changing the positions of the rollers 22.

Specifically, for example, a state in which the second roller 22B and the fourth roller 22D are both located at the uppermost position P1 and the transport path length of the target recording medium M is maximized can be illustrated as FIG. 9. Further, a state in which the second roller 22B and the fourth roller 22D are both located at the lowermost position P2 and the transport path length of the target recording medium M is minimized can be illustrated as FIG. 10. Further, a state in which the second roller 22B is located at the uppermost position P1 and the fourth roller 22D is located at the lowermost position P2, and the transport path length of the target recording medium M is intermediate between those of the states illustrated in FIGS. 9 and 10 can be illustrated as FIG. 11.

Note that the disclosure is not limited to the aforementioned example, and many variations are possible within the scope of the disclosure as described in the appended claims. It goes without saying that such variations also fall within the scope of the disclosure. For example, the configuration of the transport path length changing unit 20 is not limited to the above, the number, moving directions, and the like of the rollers 22 may be changed with respect to the above-described examples, and the transport path length changing unit 20 may be configured to change the transport path length of the target recording medium M without using the rollers 22.

What is claimed is:

1. A recording device comprising:

a feeding unit configured to feed out a target recording medium while supporting the target recording medium in a roll form;

a head configured to eject ink to a surface of the target recording medium fed from the feeding unit, thereby forming an image on the surface;

a corona irradiation unit arranged between the feeding unit and the head in a transport path of the target recording medium and configured to modify the surface by performing corona irradiation; and a transport path length changing unit arranged between the corona irradiation unit and the head in the transport path and configured to change a length of the transport path.

2. The recording device according to claim 1, further comprising:

a control unit, wherein the corona irradiation unit is configured to change an output of the corona irradiation, the transport path length changing unit includes a roller around which the target recording medium is windable and a roller moving unit configured to change the length of the transport path by moving the roller, and the control unit controls the roller moving unit to move the roller according to the output.

3. The recording device according to claim 2, wherein the control unit controls the roller moving unit to control an arrangement of the roller so that a radical attached to the surface by the corona irradiation is deactivated before reaching a position facing the head during the transport of the target recording medium, the control being performed according to a deactivation time of the radical corresponding to the output.

4. The recording device according to claim 3, wherein the control unit is configured to calculate the deactivation time of the radical from the output, and to control the arrangement of the roller based on the calculation result and a transport time from the corona irradiation unit to the head based on a transport speed of the target recording medium.

5. The recording device according to claim 3, comprising:

a storage unit storing data related to the deactivation time based on the output and a transport time from the corona irradiation unit to the head based on a transport speed of the target recording medium, wherein the control unit controls the arrangement of the roller based on the data.

6. The recording device according to claim 1, wherein the transport path length changing unit includes a roller around which the target recording medium is windable and a roller fixing unit configured to fix the roller at a plurality of positions, and the transport path length changing unit is configured to change the length of the transport path by changing a position at which the roller is fixed.

7. The recording device according to claim 1, wherein the transport path length changing unit includes a plurality of rollers around which the target recording medium is windable, and the transport path length changing unit is configured to change the length of the transport path by changing the roller around which the target recording medium is wound.

8. A recording method for a recording device comprising a feeding unit configured to feed out a target recording medium while supporting the target recording medium in a roll form, a head configured to eject ink to a surface of the target recording medium fed from the feeding unit, thereby forming an image on the surface, a corona irradiation unit arranged between the feeding unit and the head in a transport path of the target recording medium and configured to modify the surface by performing corona irradiation, the recording method comprising:

changing a length of the transport path between the corona irradiation unit and the head according to an output of the corona irradiation unit, and subsequently transporting the target recording medium and forming an image by the head.

* * * * *